United States Patent [19]

Geller et al.

[11] Patent Number: 4,636,753

[45] Date of Patent: Jan. 13, 1987

[54] GENERAL TECHNIQUE FOR THE INTEGRATION OF MIC/MMIC'S WITH WAVEGUIDES

[75] Inventors: Bernard D. Geller, Rockville; Amir I. Zaghloul, Bethesda, both of Md.

[73] Assignee: Communications Satellite Corporation, Washington, D.C.

[21] Appl. No.: 610,537

[22] Filed: May 15, 1984

[51] Int. Cl.[4] ..... H01P 5/107

[52] U.S. Cl. ..... 333/26; 333/34; 333/35; 333/238

[58] Field of Search ..... 333/21 R, 26, 238, 246, 333/248; 455/327, 328

[56] References Cited

U.S. PATENT DOCUMENTS

| | | | |
|---|---|---|---|
| 3,732,508 | 5/1973 | Ito et al. | 333/21 R |
| 3,995,239 | 11/1976 | Head et al. | 333/21 R |
| 4,123,730 | 10/1978 | Fikart | 333/26 |
| 4,291,415 | 9/1981 | Buntschuh | 333/26 X |
| 4,406,020 | 9/1983 | Reindel | 455/327 |
| 4,409,566 | 10/1983 | Patton et al. | 333/26 |

*Primary Examiner*—Paul Gensler

*Attorney, Agent, or Firm*—Sughrue, Mion, Zinn, Macpeak and Seas

[57] ABSTRACT

A technique for packaging and integrating of a microwave integrated circuit (MIC) or monolithic microwave integrated circuit (MMIC) with a waveguide uses a printed conductive circuit pattern on a dielectric substrate to transform impedance and mode of propagation between the MIC/MMIC and the waveguide. The virtually coplanar circuit pattern lies on an equipotential surface within the waveguide and therefore makes possible single or dual polarized mode structures.

14 Claims, 8 Drawing Figures

GENERAL TECHNIQUE FOR THE INTEGRATION OF MIC/MMIC'S WITH WAVEGUIDES

The invention described herein was made in the performance of work under NASA Contract No. NAS 3-23250 and is subject to the provisions of Section 305 of the National Aeronautics and Space Action of 1958 (72 Stat. 435; 42 U.S.C. 2457).

BACKGROUND OF THE INVENTION

1. Field of the Invention

The invention relates to the packaging and interconnection of microwave integrated circuits or monolithic microwave integrated circuits with a waveguide structure. (As used herein microwave integrated circuit will be taken generically to mean both microwave integrated circuits and monolithic microwave integrated circuits.) At both the transmit and receive ends of a microwave communications or radar system, energy radiators in the form of horns or slots are provided. It is necessary to transfer energy efficiently between microwave integrated circuits and these radiators. In order to achieve efficient energy transfer, it is necessary to transform the waveguide impedance and mode of propagation to that of the microwave integrated circuits and vice versa.

2. Description of the Prior Art

The prior art describes two techniques for providing impedance matching and mode conversion to effect energy transition between a microwave integrated circuit and a waveguide.

A first technique uses a coaxial connector element between a waveguide and a microwave integrated circuit. This technique has the disadvantages of relatively large size and weight, narrow bandwidth and considerable insertion losses of the circuit, especially at high frequencies. Consequently, it is of little or no use for certain applications such as direct broadcast satellite transmission.

The second technique uses a ridged waveguide transformer inserted in the waveguide between a full height section of the waveguide and the microwave integrated circuit. This technique has the disadvantage of using a device requiring highly complex and precise machining steps during fabrication. In addition, positioning the transformer in the waveguide requires difficult assembly procedures.

The introduction of monolithic microwave integrated circuits (MMIC's) has caused several additional problems directly related to their small size and fragility. With microstrip, it is possible to contact the substrate with a coaxial center conductor or a flat metal tab. Establishing a reliable contact is very difficult, if not impossible, with an MMIC circuit due to its fragility. Consequently, it is necessary to package MMIC's in a way which maximizes performance and reliability and minimizes size and weight.

SUMMARY OF THE INVENTION

The invention relates to the incorporation of a microwave integrated circuit (MIC) or a monolithic microwave integrated circuit (MMIC) with a waveguide by attaching the circuit on a dielectric substrate having a predetermined electrical conductor pattern thereon and then locating the substrate within a section of the waveguide. In a preferred embodiment, an MMIC is either soldered or epoxied directly onto a metallized surface of a ceramic substrate, with the substrate surface parallel to the electric field and approximately centered within the waveguide. On the metallized surface of the substrate, the structure includes a unilateral finline transition from the waveguide to a slotline and a broadband balun for converting the balanced slotline mode to the unbalanced microstrip or coplanar waveguide (CPW) on the MMIC.

It is an object of the present invention to couple an MMIC to a waveguide while transforming the impedance and mode of propagation between the waveguide and the MMIC so that energy may be transferred efficiently between the structures.

It is another object of the invention to integrate MMIC's with waveguides in a small lightweight package which can be removed easily for adjustment or repairs and which allows reproducible and non-invasive measurement of the MMIC chips.

It is a further object of the invention to provide a device which may be used with rectangular, square or circular waveguides to accommodate dual, or orthogonally polarized electric fields.

It is a yet further object of the invention to provide an MMIC waveguide transition device that is reliable, less expensive and is simple to fabricate, with little or no machining.

The aforementioned and other objects and features of the invention will become more apparent from the following description taken in conjunction with the drawings.

DESCRIPTION OF THE PREFERRED EMBODIMENT(S)

Figure 1A:
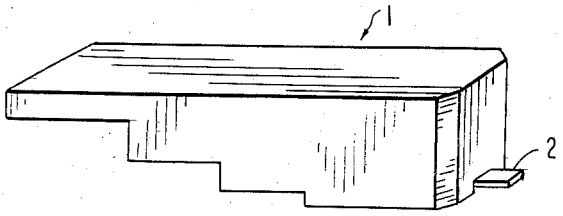
FIG. 1a PRIOR ART
FIG. 1*a* is a depiction of a conventional waveguide transition device consisting of a stepped ridge transformer.

FIG. 1*a* shows a conventional waveguide transition device consisting of a stepped ridge transformer 1. It can be seen that the device which, of necessity, must be very small, has a highly complex geometry requiring precise, sophisticated machining with critical tolerances.

Figure 1B:
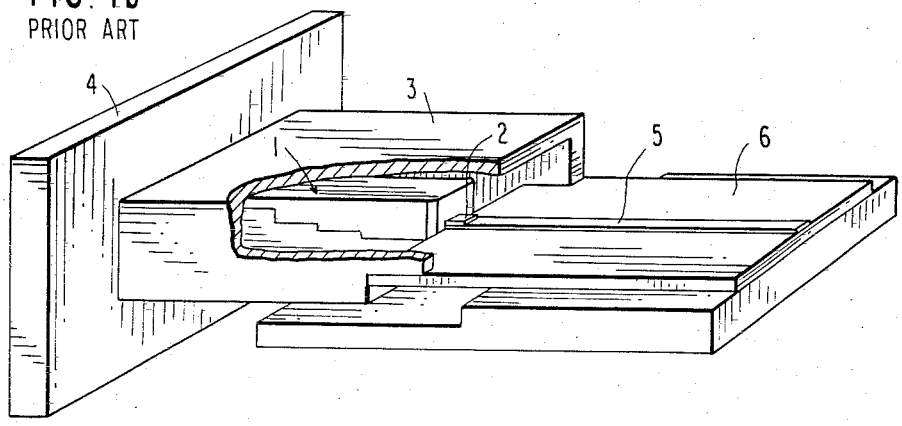
FIG. 1b PRIOR ART
FIG. 1*b* shows the position of the device shown in FIG. 1*a* positioned within a rectangular waveguide.

Now with reference to FIG. 1*b*, the transformer of FIG. 1*a* is shown inserted within a rectangular waveguide 3 which may be bolted to a radiator or other component (not shown) of a microwave system by means of flange 4. The transformer is electrically connected in circuit by means of a spring-loaded contact 2 which engages microstrip transmission line 5. The microstrip transmission line runs along the length of a ceramic substrate 6 which has a metallic base plate (not shown) forming a ground plane.

The position of the transformer must be such that it is in perfect alignment with the electric field present within the waveguide. The stepped ridge transformer disallows its use in dual polarized applications since one polarization will be cut off in the plane for which the device has not been aligned.

As used herein, a finline is a general term for a type of microstrip transmission line comprising a very thin metallized section on a substrate which forms a wall that runs down the length of a waveguide wherein two opposing walls form a gap therebetween and the electric field is concentrated on the edges or "fin" of the walls forming this gap. Ideal thin conductors are assumed for the fins. It is a "balanced" device in that at any point along the finline a voltage +V will be present on one wall edge and a voltage −V will be present directly across from it while zero voltage will be present at the center of the finline. A finline must be positioned within a waveguide in order for the electric field to propagate within the gap. This is in contrast to an unbalanced device which requires a conductor and a ground plane wherein the conductor has some potential difference +V or −V with respect to the ground plane. Finline may be unilateral, i.e., both fins on the same side of the substrate or antipodal, i.e., one fin on one side of the substrate and another fin on the opposite side of the substrate. A slotline is similar to a finline in that it is a balanced device, however, it need not be positioned within a waveguide to propagate the electric field. A balun is a passive circuit for transmitting energy from a balanced system or device to an unbalanced system or device. A waveguide is a device wherein the electric field is found everywhere within the cross-section of the waveguide.

Figure 2A:
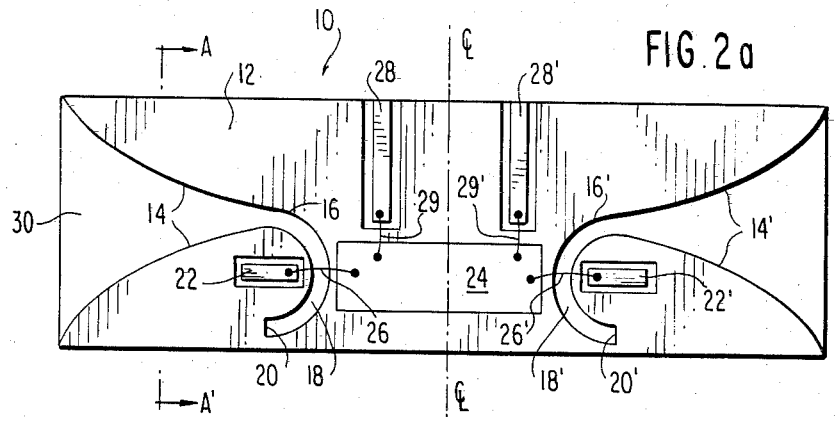
FIG. 2*a* shows an MMIC mounted on a waveguide transition device according to a first embodiment of the present invention.

FIG. 2*a* shows an MMIC waveguide transition device 10 according to a preferred embodiment of the present invention. For purposes of simplification, the following discussion will refer to the left side of the transition device. As can be readily seen, the device is symmetrical with respect to the center line. A metallized surface 12 is deposited on a dielectric substrate 30 which may be typically a ceramic, such as alumina or beryllia. The substrate is metallized on only one surface. The metallization is removed, such as by etching, to cut a tapered, unilateral finline impedance transformer 14. The taper begins at both edges of the structure and converges inwardly. The taper may be sinusoidal, exponential, or stepped, as dictated by bandwidth, size limitations, or other requirements. The most common realization of a transformer according to the present invention would use a sinusoidal or exponential taper rather than a stepped, quarter-wavelength "taper" due to the uncertainties associated with the characteristic impedances and discontinuities in a stepped transformer. A disadvantage of the curved taper, however, is that it requires a greater length than the stepped version for a given return loss. A general advantage of unilateral finlines over antipodal finlines, is that in the presence of two orthogonal fields, the former will couple almost exclusively to the field with which it is aligned while the latter will couple to both fields. This property makes possible dual polarized structures such as phased array elements and dual mode filters. The present invention utilizes unilateral finlines.

The finline connects to one end 16 of a semi-circular slotline 18, the other end 20 of which comprises a short circuit. A coplanar waveguide (CPW) structure 22, etched into the metallized surface 12, is shown positioned on a side opposite of the slotlines 18 from an MMIC chip 24 which is soldered or epoxied directly on a portion of metal surface 12. Wire 26 passes over the slotline 18 and connects the CPW 22 with the MMIC chip 24 to effect energy transfer between the chip 24 and the slotline through the magnetic and electric fields present at this junction. The electric field across the slotline 18 produces a magnetic field perpendicular to the transition plane, which couples to the magnetic field of the wire 26. The balun according to the present invention comprises CPW 22, the bottom half of semi-circular slotline 18, dimensioned to equal a one-quarter wavelength of the center of the operating frequency of the system in which the device will be used, and wire bond 26. The device may be tuned by adjusting the length of the short-circuited slotline.

It readily can be seen that structures 14', 16', 18', 20', 22', and 26' are configured similarly to their counterparts discussed hereinabove.

Two additional CPW structures 28 and 28' are connected to the MMIC by means of wire bonds 29, 29' to provide DC power to the MMIC device.

By way of example, the left side of the Figure would be the input side of the device wherein a propagated field in a waveguide is transformed to an input of the MMIC and the right side of the Figure would be the output side of the device transforming the output of the MMIC to a field for propagation in another section of waveguides. Thus, assuming RF power enters at the left end of the device, it will depart from the right end.

Figure 2B:
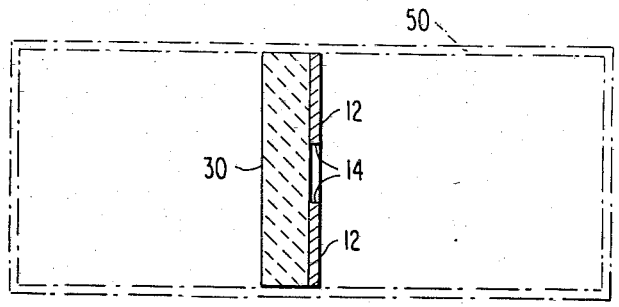
FIG. 2*b* is a section view taken along the line A—A' of FIG. 2*a*.

FIG. 2*b* is an illustration of the device taken along section A—A' of FIG. 2*a* showing the MMIC waveguide transition device 10 positioned within a rectangular waveguide 50. A pair of spring-fingered beryllium-copper rails (not shown) are mounted on the edges of the substrate to make contact between the gold metallization of the substrate and the waveguide walls. The metallized surfaces 12 and the edges of finline 14 are seen and the dielectric substrate 30 is also shown. It should be recognized that FIG. 2*b* is "not-to-scale" as the metallized surface has virtually no thickness relative to the substrate. Further, FIG. 2*b* does not depict the MMIC chip as its inclusion in the Figure is not necessary to understand the invention. Since the circuit is virtually coplanar, it lies on an equipotential surface for a horizontally polarized electric field and appears transparent to that polarization.

Figure 2C:
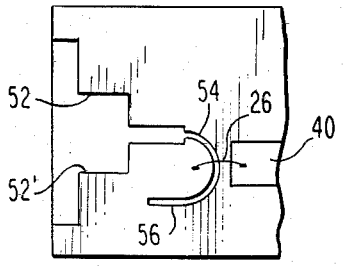
FIG. 2*c* shows a simplified waveguide transition device according to another embodiment of the invention.

FIG. 2*c* shows a variation comprising a stepped finline-slotline arrangement. The first three sections are quarter wavelength sections in the finline 52 and the fourth is a quarter wavelength section of the slotline 54. Tuning is achieved as above by adjusting the short-circuited stub 56 of the slotline.

Figure 3:
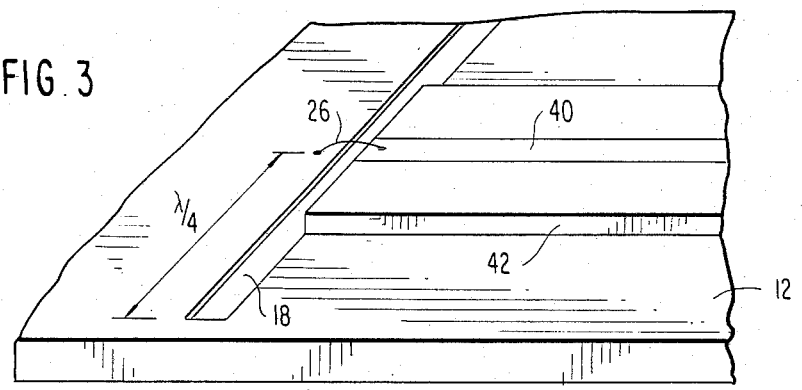
FIG. 3 is a functional close-up view of the balun of FIG. 2*c* indicating the required wire bond and quarter wavelength short-circuited slotline section.

FIG. 3 shows a simplified close-up of the balun structure used in FIG. 2*c*, including the required wire bond and quarter wavelength short-circuited slotline section. The other components and connections shown in FIG. 2*a* would be required to fully implement the invention. A microstrip 40 is positioned on a ceramic substrate 42 which is adhered to the metallized surface 12 of the device. Wire bond 26 connects the microstrip to a portion of the metalized surface on a side opposite to slotline 18. Again, the length of the slotline from the bond wire to the short circuit end of the slotline is dimensioned to equal one-quarter wavelength of the center of the operating frequency. The open circuit side of the slotline connects to the finline similar to that of the FIG. 2*a* arrangement. The structure of FIG. 3 is simpler than that of FIG. 2*a* in that CPW 22 is not required but the bandwidth of the FIG. 3 balun is not as great as that of the FIG. 2*a*.

Figure 4:
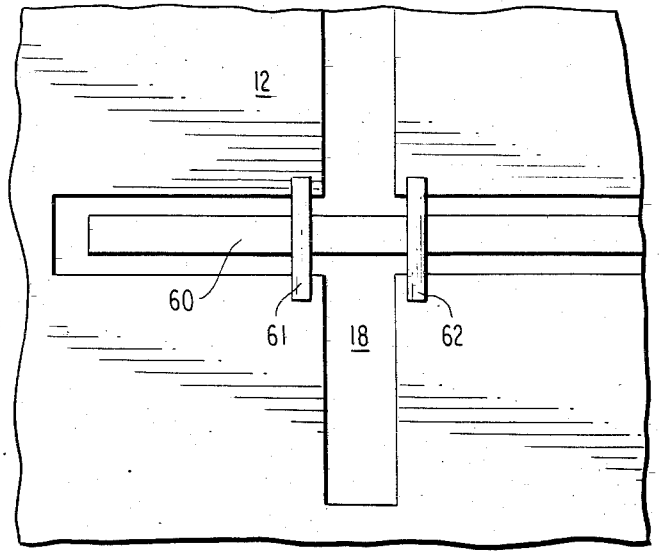
FIG. 4 is yet another alternative balun structure which may be used in the present invention.

FIG. 4 shows another balun structure comprising an extended CPW 60 crossing through the slotline 18 which may be substituted for the baluns described hereinabove. As above, it is understood that the Figure only shows a variation on the balum structure and the other components and connections shown in FIG. 2*a* are required to implement the invention. Metallized areas 12 are connected by means of air bridges 61 and 62 to establish a DC connection between sides of the metallized areas opposite the CPW 60. This embodiment is useful if an MMIC is not to be mounted proximate to the slotline on the transition structure since the CPW can extend to any desired length.

Figure 5:
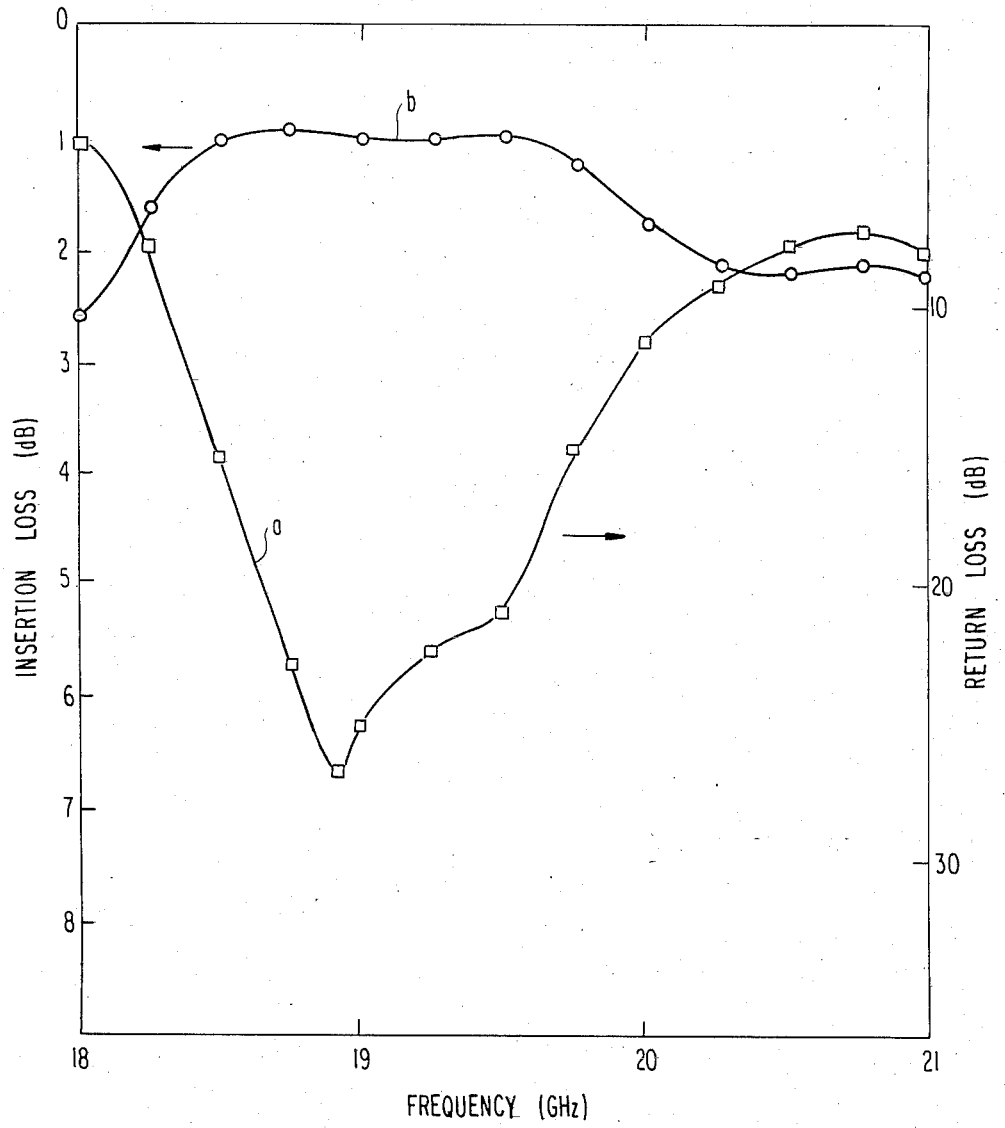
FIG. 5 is a graph showing the return loss and insertion loss performance of the present invention as a function of frequency.

FIG. 5 shows insertion loss curves and return loss curves as a function of frequency for an MMIC chip integrated with a waveguide transition device according to the present invention. The insertion loss is a measure of the power lost between the input and the output and the return loss is a measure of the power reflected by the input port. Optimal results are achieved by making the insertion loss as low as possible and the return loss as high as possible for a given frequency. Curve (a) shows the return loss of more than 25 dB for an operating frequency of 19 GHz. Curve (b) shows that at 19 GHz, there is an insertion loss of approximately 1 dB. Of this, approximately 0.4 dB is due to losses in the short microstrip section and 0.3 dB is due to each transition. The latter figure may be further reduced by use of a substrate with a smoother surface. These performance figures are comparable to or better than many conventional waveguide transition devices which in many cases are impractical or impossible to use in given applications as discussed above.

Electrically, the present invention will couple, with very little loss of power, between a waveguide and an MIC/MMIC in single or dual polarized systems. Mechanically, it provides a single-piece, rugged and easily reproduced module that can be produced inexpensively. Finally, the use of beryllia for the substrate material allows for a low thermal resistance structure.

Although the invention has been described and shown in terms of preferred embodiments thereof, it will be understood by those skilled in the art that changes in form and details may be made therein without departing from the spirit and scope of the invention.

What is claimed is:

1. A microwave transition device for coupling a waveguide and a microwave integrated circuit, said transition device being located within said waveguide for alignment with an electric field having microwave energy, said device comprising: a dielectric substrate having a metallized surface on only one side thereof; a unilateral finline formed in said metallized surface at an end portion of said substrate; a slotline formed adjacent to said finline on said metallized surface and connected to said finline at one end thereof; and a balun positioned proximate to said slotline, said microwave integrated circuit being attached to said metallized surface and connected to said balun, wherein said balun comprises a portion of said slotline equal in length to $\frac{1}{4}$ of the wavelength of the electric field and a wire bond, passing over said portion of said slotline, and connected at one end to said microwave integrated circuit and at an opposite end to said metallized surface.

2. The device of claim 1 wherein said microwave integrated circuit is an MMIC.

3. The device of claim 1 wherein the finline is realized with an inwardly converging, sinsuoidally tapering configuration.

4. The device of claim 1 wherein the finline is realized with an inwardly converging, exponentially tapering configuration.

5. The device of claim 1 wherein the finline is realized with a stepped, quarter-wavelength configuration.

6. The device of claim 1 wherein said device supports only a single polarization.

7. The device of claim 1 wherein said balun further comprises a coplanar waveguide positioned on a side opposite of said slotline from said microwave integrated circuit said wire bond connecting said coplanar waveguide to said microwave circuit.

8. The device of claim 7 wherein said slotline is in the configuration of a semicircle and said portion of said slotline forms $\frac{1}{2}$ of said semicircle extending from a midway point of said slotline to a short-circuited end of said slotline opposite to an open-circuited end connected to said finline.

9. The device of claim 7 wherein said device supports only a single polarization.

10. The device of claim 1 wherein said balun further comprises a coplanar waveguide intersecting said slotline.

11. The device of claim 10 further comprising air bridges for connecting surfaces of said metallized surface on either side of said coplanar waveguide to form continuous wall edges of said slotline intersected by said coplanar waveguide.

12. The device of claim 1 wherein said substrate is a ceramic material.

13. The device of claim 12 wherein said ceramic material is beryllia.

14. The device of claim 12 wherein said ceramic material is alumina.

* * * * *